US012122574B2

(12) United States Patent
Gloor et al.

(10) Patent No.: US 12,122,574 B2
(45) Date of Patent: Oct. 22, 2024

(54) CLOSURE ARRANGEMENT FOR A VESSEL CONTAINING A PHARMACEUTICAL SUBSTANCE

(71) Applicant: Datwyler Pharma Packaging Belgium, Alken (BE)

(72) Inventors: Daniel Joel Gloor, Steinhausen (CH); Ralf Dittmer, Straubenhardt (DE)

(73) Assignee: Datwyler Pharma Packaging Belgium, Alken (BE)

( * ) Notice: Subject to any disclaimer, the term of this patent is extended or adjusted under 35 U.S.C. 154(b) by 171 days.

(21) Appl. No.: 17/786,610

(22) PCT Filed: Dec. 16, 2020

(86) PCT No.: PCT/EP2020/086343
§ 371 (c)(1),
(2) Date: Jun. 17, 2022

(87) PCT Pub. No.: WO2021/122688
PCT Pub. Date: Jun. 24, 2021

(65) Prior Publication Data

US 2023/0008277 A1 Jan. 12, 2023

(30) Foreign Application Priority Data

Dec. 18, 2019 (DE) ..... 10 2019 135 009.3

(51) Int. Cl.
*B65D 51/24* (2006.01)
*B65D 51/00* (2006.01)
*B65D 51/20* (2006.01)

(52) U.S. Cl.
CPC ..... *B65D 51/245* (2013.01); *B65D 51/002* (2013.01); *B65D 51/20* (2013.01);
(Continued)

(58) Field of Classification Search
CPC ..... B65D 51/002; B65D 2401/15; B65D 2401/05; B65D 2203/10; B65D 55/028;
(Continued)

(56) References Cited

U.S. PATENT DOCUMENTS 4,471,879 A * 9/1984 Connor ..... B65D 51/002 215/249
5,152,413 A * 10/1992 Conrad ..... B21D 51/38 215/249

(Continued)

FOREIGN PATENT DOCUMENTS

WO 2013/149844 A1 10/2013
WO 2016/090073 A1 6/2016

(Continued)

OTHER PUBLICATIONS

International Search Report of PCT/EP2020/086343, mailed Apr. 14, 2021.

*Primary Examiner* — Mollie Impink
(74) *Attorney, Agent, or Firm* — Collard & Roe, P.C.

(57) ABSTRACT

A closure arrangement for a vessel containing a pharmaceutical substance, having a stopper, a metal cap, for securing the stopper on the vessel, and an overcap made of plastic, wherein, for the purpose of identifying contents of the vessel, a wirelessly readable, electrical memory unit is connected to the closure arrangement. In order for a closure arrangement of the type in question to be improved further, in particular in respect of tamper-evident sealing the memory unit is operatively connected both to the overcap and to the stopper, and the operative connection has a lasting effect on the memory unit when the overcap is torn off.

15 Claims, 10 Drawing Sheets

(52) U.S. Cl.
CPC .. *B65D 2203/10* (2013.01); *B65D 2251/0015* (2013.01); *B65D 2251/0075* (2013.01)

(58) Field of Classification Search
CPC ... A61J 1/1406; A61J 2205/60; A61J 2200/70
See application file for complete search history.

(56) References Cited

U.S. PATENT DOCUMENTS

| | | | | |
|---|---|---|---|---|
| 7,782,212 | B2 * | 8/2010 | Burns | G06K 19/0723 340/10.5 |
| 10,450,116 | B2 | 10/2019 | Diaz et al. | |
| 2006/0049948 | A1 * | 3/2006 | Chen | G06K 19/07798 235/492 |
| 2007/0296599 | A1 | 12/2007 | Wang et al. | |
| 2009/0306620 | A1 | 12/2009 | Thilly et al. | |
| 2015/0186770 | A1 * | 7/2015 | Arai | B65D 41/3447 235/492 |
| 2015/0298414 | A1 * | 10/2015 | Dittmer | B29D 99/0096 156/242 |
| 2017/0316302 | A1 | 11/2017 | Clere et al. | |
| 2020/0193262 | A1 | 6/2020 | Giovannini et al. | |

FOREIGN PATENT DOCUMENTS

| | | | | |
|---|---|---|---|---|
| WO | WO-2018136927 | A1 * | 7/2018 | B65D 41/045 |
| WO | 2018/189133 | A1 | 10/2018 | |
| WO | 2019/076430 | A1 | 4/2019 | |

* cited by examiner

V
18
6
9
12
x
11
5
7
1
13
4
8
10
34
d
3
2
x 1
5
6
21
11
23
18
7
17
20
19
8
3
4
22
10

CLOSURE ARRANGEMENT FOR A VESSEL CONTAINING A PHARMACEUTICAL SUBSTANCE

CROSS REFERENCE TO RELATED APPLICATIONS

This application is the National Stage of PCT/EP2020/086343 filed on Dec. 16, 2020, which claims priority under 35 U.S.C. § 119 of German Application No. 10 2019 135 009.3 filed on Dec. 18, 2019, the disclosure of which is incorporated by reference. The international application under PCT article 21(2) was not published in English.

FIELD OF THE INVENTION

The invention relates to a closure arrangement for a vessel containing a pharmaceutical substance, having a closure stopper, a metal cap for securing the closure stopper on the vessel, and an overcap made of plastic, wherein, for the purpose of identifying contents of the vessel, a wirelessly readable, electrical memory unit is connected to the closure arrangement.

PRIOR ART

Closure caps of the kind currently under discussion are known for example from WO 2013/149844 A1 (US 2015/0298414 A1). In addition, reference can also be made for example to WO 2016/090073 A1 (U.S. Pat. No. 10,450,116 B2) and WO 2019/076430 A1 (US 2020/193262 A1). Such closure caps are used in particular for the allocating of vessels for receiving a pharmaceutical substance, for example for arrangement on an ampoule. Here, the closure cap, in particular with use of the metal cap, in particular embodied in the manner of an aluminium cap, can be formed as a crimp cap, wherein the metal cap serves to arrange a preferably rubber-like stopper in a manner held in place in the region of the container opening. The overcap is used as a further part of the closure arrangement associated with the metal cap, for example as a cover part. This overcap is removed from the metal cap, for example as a result of having been torn off, in order to expose the metal cap and for possible subsequent use of the vessel closed by the closure arrangement.

The overcap, in particular the overcap consisting of a plastic, can also be a tamper-evident closure for the metal cap as a whole, wherein, in this context, the production of such an overcap for example by way of a plastics injection-moulding process, is also known. Such an overcap may thus also consist for example of polypropylene (PP) or polyethylene (PE).

It is also known to provide such a closure arrangement with a wirelessly readable memory unit. For example, information regarding the contents (composition of the vessel contents, active substances, manufacturer, etc.) and/or also for example information regarding the filling date and/or expiry date of the substance stored in the vessel can be stored in such a memory unit.

SUMMARY OF THE INVENTION

In view of the prior art described above, the object of the invention is to further improve a closure arrangement of the type currently under discussion, in particular in respect of a tamper-evident closure.

One possible solution to the problem is achieved in accordance with a first inventive concept with a closure arrangement of which the objective is to provide an operative connection of the memory unit both to the overcap and to the closure stopper, said connection having a lasting effect on the memory unit once the overcap has been torn off.

The removal or tearing of the overcap from the metal cap and the closure stopper overlaid by the metal cap can indicate the status of first use of the vessel closed by the closure arrangement. Such a first use can be detected and optionally recorded by a lasting effect on the memory unit resulting from removal of the overcap. For example, when the memory unit is read following a removal of the overcap, the first-use status can advantageously be determined. Such a first-use status is preferably also not amendable by fitting the plastic cap back in place. Rather, due to the lasting effect on the memory unit, such a first-use status is permanently valid so to speak, so that a removal of the overcap (even performed earlier in time) can be detected at any later point in time.

When the overcap is torn off, a corresponding status can be set or deleted in the memory unit, in particular in a possible memory chip, optionally actively via an electronic pulse, said status being readable preferably wirelessly in order to determine the tamper-evident closure state.

When the overcap is torn off, it is also possible that this removal be logged in or at the memory unit by a permanent marking, for example by a mechanically produced marking.

In particular, such a (mechanical) marking can optionally be identified directly by the user or indirectly using a conventional reader to read the information stored in the memory unit.

In a preferred embodiment at least the part of the memory unit containing or storing the necessary information remains on or in the closure arrangement, at least over the usual period of use of the vessel.

Further features of the invention are explained hereinafter, also in the figure description, often in their preferred assignment to the subject matter of claim 1 or to features of further claims. However, they may also be significant in an assignment to only some of the features of claim 1 or the relevant further claim, or independently in each case.

For example, in accordance with a possible embodiment, a separation means can be provided, which has a lasting effect on the memory unit once the overcap has been torn off. Alternatively, the memory unit for example can also be fastened in part to the overcap and in part to the closure stopper, wherein a lasting effect on the memory unit thus results once the overcap has been torn off. In both cases, an operative connection of the memory unit both to the closure stopper and to the overcap is provided either directly or indirectly (via the separation means).

The memory unit, which has been influenced as a result of the overcap being torn off, when the stored information is read can provide information that is generated in a lasting manner as a result of the overcap having been torn off. Accordingly, such information can be stored actively in the memory unit when the overcap is torn off or such information can be generated during the course of the reading process. In a further embodiment, the information can be generated in this way for example only with use of a suitable reader.

The lasting influence on the memory unit can be provided in accordance with a possible embodiment by a complete severing (tearing through) of the memory unit, wherein the portion of the memory unit containing the relevant and readable information preferably remains on the closure stopper and thus on the vessel. Alternatively, the memory unit and an associated antenna, or only the memory unit or only the antenna can also be removed. As a result of the possibly completely torn-off portion of the memory unit in such an embodiment, an optical signal alone can be provided for the user. In addition, such a missing portion of the memory unit for example can also be recorded in the event of a wireless reading of the information stored in the memory unit. For example, such a missing or also damaged portion can also influence the data transfer. The result of this is that data transfer is no longer possible.

Such a lasting effect on the memory unit can also be provided by cutting or tearing into the memory unit. In this case, a portion of the memory unit is not fully removed. However, such an incision, similarly to a complete severance, is irreversible and therefore initially also optically detected. In addition, the removal of the overcap can also be stored in a lasting way electronically as a result of the memory unit having been cut into or torn into in this way, and for example can also be evidenced here for example by an influencing of the data transfer.

The memory unit in a further embodiment can be an RFID tag and an NFC tag or can comprise such a tag. RFID and NFC are wireless or contactless communication technology. Here, the communication between a memory unit and an electrically operated reader is made possible. For example, such systems preferably consist of a reader and a transponder (tag), wherein a distinction is made for the tags between active and passive transponders. Active tags have their own power source (battery), whereas passive tags do not have their own power source but are supplied with energy via the electromagnetic field generated by the reader. In the present invention, passive tags are preferably used.

In a further embodiment, high-frequency RFID (radio-frequency identification) or NFC (near-field communication) tags are used, for example with a frequency of from approximately 10 to 15 MHz, for example approximately 13.56 MHz. Such transponders have a relatively short range, and therefore a reader must be located in the direct vicinity of the transponder and thus of the closure arrangement and vessel in order to read the stored data. The distance here can be a few centimetres, for example 2 to 5 up to 10 cm.

The lasting effect on such a transponder when the overcap is torn off can be achieved, for example, by a corresponding influencing of the antenna of the tag, for example by tearing off or into part of the antenna or additionally as a result of expansion or stretching of the antenna as a whole or of part thereof.

The memory unit can be adhesively connected to the overcap and/or the closure stopper fully or over its entire surface area, preferably in part. In this regard, a permanently fixed adhesive connection is preferred, so that, if the overcap is removed or torn off, a lasting load and effect is exerted on the memory unit. For example, as a result of such an adhesive connection of the memory unit, it can be made possible to tear into or tear through the memory unit along a predefined predetermined tear line similarly to with an embedment in the particular material, on the one hand with the closure stopper and on the other hand with the overcap. In the event that the memory unit is torn through in this way, the portion storing the relevant information preferably remains on the closure stopper and therefore the vessel, and as applicable a further portion of the memory remains on the removed plastic cap.

The memory unit, in its region associated with the overcap, can also be overmoulded partly or fully with plastic, for example with the plastic forming the overcap. Accordingly, the relevant part of the memory unit can thus be fixed to or in the overcap during the course of production of the latter. A further portion of the memory unit can protrude in a flag-like manner and, once the plastic cap has been fitted in place, can be adhesively bonded to the closure stopper for example by means of the metal cap or directly in order to produce the tamper-evident closure.

In a further preferred embodiment, removal of the overcap has a destructive effect on the memory unit. Hereafter, the memory unit is preferably marked irreversibly, in particular fully or partly, but in doing so is destroyed in a manner impairing its function, so that the memory unit is lastingly influenced in respect of its function and/or in respect of any stored information content, following removal of the overcap. The destruction may affect an RFID tag or NFC tag of the memory unit, for example directly or indirectly.

The destruction can be provided by an irreversible separation of two regions of the memory unit from another. Furthermore, and preferably, a partial region of the memory unit can be separated from the memory unit during the course of the destruction process, for example in the manner of a tear-off portion.

The metal cap can have an opening which, in a preferred embodiment, can be larger than half up to eight tenths or nine tenths or more of the outer diameter of the metal cap. The top of the cap that results here and surrounds the opening can overlap the closure stopper, for example at the edge and circumferentially merely in a collar-like manner.

The memory unit can also be accommodated lying loosely between the metal cap and the closure stopper. A mount for the memory unit lying substantially on the closure stopper can be provided possibly solely by at least partial overlapping of the memory unit by the metal cap. In particular, production-related advantages can result herefrom, but additionally also advantages in the course of a possible sorted disposal.

Alternatively, the memory unit also might not be non-destructively removably connected to the closure stopper, for example fully or partially, for example by adhesive bonding or full or partial overmoulding with material forming the closure stopper.

The memory unit overmoulded with plastic in a possible embodiment can have a predetermined tear line for separating part of the memory unit. A predetermined tear line of this kind can be provided for example by a limited thinning of the plastic material along, for example, a straight or circular line. Alternatively, a predetermined tear line of this kind can also be provided by a perforation along a line, in which case apertures can be provided which are preferably uniformly distanced from one another and fully penetrate through the plastic material, possibly in a slot-like manner. The web-like portions of the plastic material connecting these apertures are preferably destroyed during the course of removal of the overcap, thus achieving a tearing-off along the predetermined tear line.

In this regard, it can also be provided that for example two predetermined tear lines are formed at a distance from one another in the tear-off direction along the predetermined tear line and are destroyed at the same time during the course of removal of the overcap. A portion that can be separated from the memory unit can thus be provided between these predetermined tear lines and can be present hereafter possibly as a lost loose part.

For example, in the region separated by the predetermined tear line, the memory unit can be acted on from beneath by a severing portion of the overcap. By means of such a severing portion, the region of the memory unit separated by the predetermined tear line or delimited by two predetermined tear lines is acted on mechanically during the course of removal of the overcap, so that destruction is achieved by separation along the predetermined tear line.

In accordance with a preferred embodiment the predetermined tear line can run through a portion of an antenna of the memory unit. The antenna as part of the memory unit is connected for example to the RFID or NFC tag. Due to the targeted destruction by separation along the predetermined tear line, the antenna can be separated for example fully from the tag. Alternatively, the length of the antenna is shortened in a targeted manner as a result of the destruction. The memory unit is then no longer functional.

With such a separation of the antenna, a shortening of the antenna length or a power reduction for example to 60% or less, for example to 50 or 40% or less, down to 5% or less of the original length or power not influenced by destruction can be achieved.

As a result of the power reduction brought about in a targeted way, for example the data stored in the tag are no longer readable from the usual distance using a reading unit brought close to the closure arrangement. The power reduction of the antenna, by targeted arrangement of the predetermined tear line, can be so great that it is no longer possible to read the tag contactlessly.

In addition, in order to separate (tear through) the memory unit, a wire can also be provided as separation means, which produces a connection between the overcap and the memory unit. The connection can be provided in respect of the memory unit in that the wire is fixedly connected to a support of the memory unit and, when the overcap is torn off, thus ensures that the memory unit is also torn off or severed. When the overcap is torn off, a targeted separation of the memory unit is thus performed or achieved via the wire.

With arrangement of such a wire, this can be fixedly connected to the overcap, for example as the result of a corresponding adhesive bonding or also overmoulding of the end of the wire facing the cap by the plastic forming the overcap.

A separation means of this kind can additionally also be provided in the manner of a blade.

BRIEF DESCRIPTION OF THE DRAWINGS

The invention will be explained hereinafter on the basis of the accompanying drawing, which merely shows exemplary embodiments. A part that is explained only with reference to one of the exemplary embodiments and in a further exemplary embodiment is not replaced by another part due to the particular feature apparent there is thus described also for this further exemplary embodiment as a part possibly present in any case. The drawing shows:

FIG. 7 a perspective illustration corresponding substantially to FIG. 1, but once the overcap has been torn off from the closure stopper with lasting effect on the memory unit;

DESCRIPTION OF THE EMBODIMENTS

Figure 1:
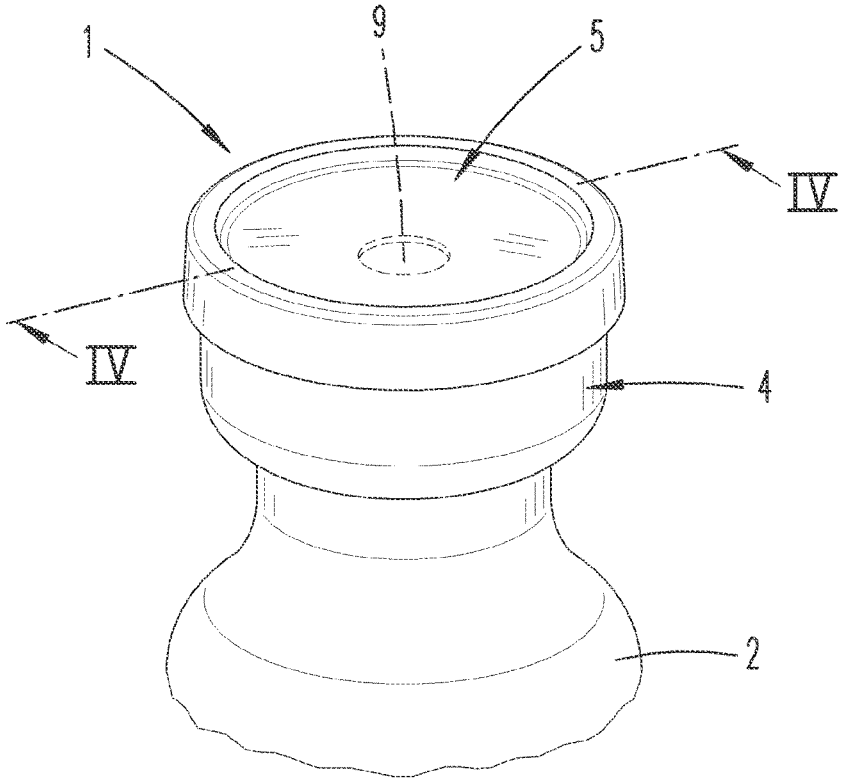
FIG. 1 a perspective illustration of a closure arrangement applied to a vessel with an overcap, relating to a first embodiment.
Figure 2:
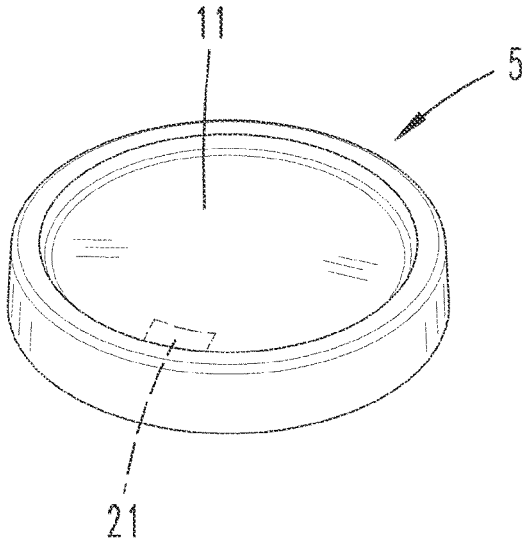
FIG. 2 the overcap in a perspective, isolated illustration.
Figure 3:
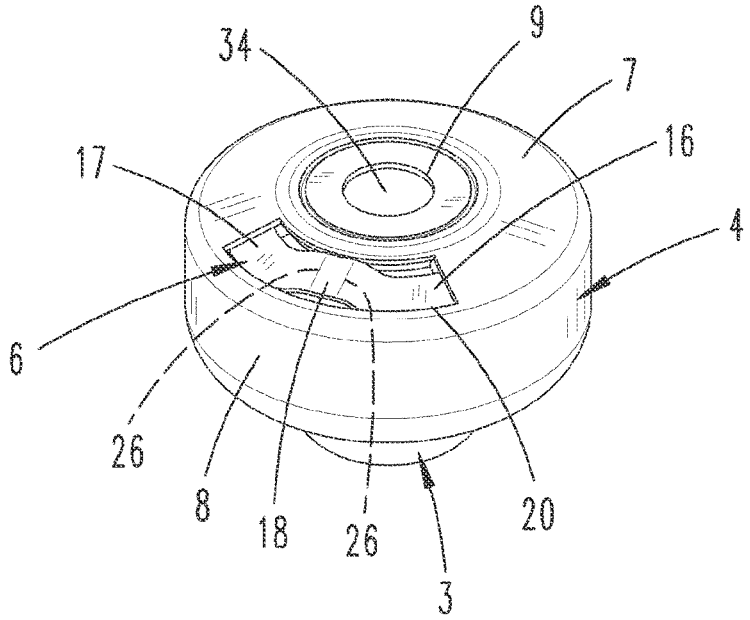
FIG. 3 the closure stopper of the closure arrangement with a metal cap overlying the closure stopper, further having an intact memory unit.

Shown and described is a closure arrangement 1 for a vessel 2, for example an ampoule, containing a pharmaceutical substance, not shown.

The closure arrangement 1 for this purpose has firstly and substantially a closure stopper 3, a metal cap 4 and an overcap 5. A wirelessly readable memory unit 6 is further preferably provided in the closure arrangement 1, in particular for identification of the contents of the vessel 2.

The metal cap 4 can be reshaped and produced from a planar aluminium strip in a preferably combined punching and reshaping process (deep-drawing process). The aluminium strip used preferably for this purpose can additionally consist of a laminate, for example consisting of a metal film layer, which can be coated on the upper and lower side with a plastics layer.

Figure 4:
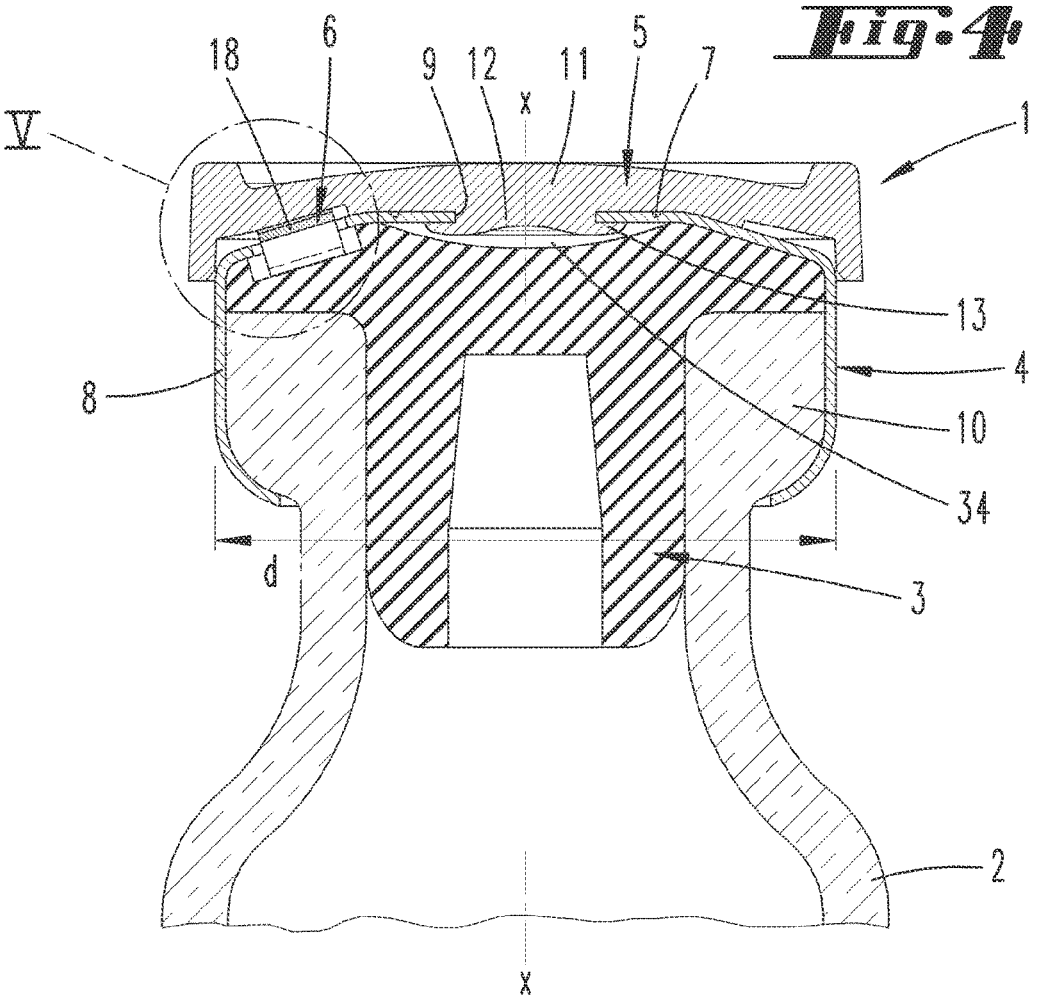
FIG. 4 the section along line IV-IV in FIG. 1.

The metal cap 4 can have a cap top 7 and, in the usual state of use, for example according to the sectional illustration in FIG. 4, a preferably downwardly running cap wall 8. An opening 9 is preferably punched out centrally in the cap top 7, and in the state ultimately applied to the vessel 2, as is shown for example in FIG. 4, can be covered by the overcap 5, which here is preferably plate-like.

The closure arrangement 1 is for example applied to the upper region of the vessel 2 according to the illustration in FIGS. 1 and 4. The elastomeric closure stopper 3 is inserted into the mouth of the vessel 2 and is surrounded on the upper side and flange side by the metal cap 4. The metal cap 4 is further preferably bent over (flanged) until it engages underneath a vessel mouth edge 10. The lower metal cap edge in this respect can be pressed on, during the course of the application of the metal cap 4 to the vessel 2, for example by a pressing tool in order to bear against the vessel 2, underneath the vessel mouth edge 10 in the shown state of engagement according to FIG. 4.

The overcap 5, which is plate-shaped in the shown embodiments, is furthermore applied to the metal cap 4 from above, in particular to overlap the opening 9, additionally preferably to form a tamper-evident closure. This overcap 5 preferably consists of a hard plastics material, additionally preferably produced by way of a plastics injection moulding process.

The overcap 5, more specifically, can have an overcap top 11, which preferably extends over the entire surface of the metal cap 4, overlapping the cap top 7 thereof.

Figure 5:
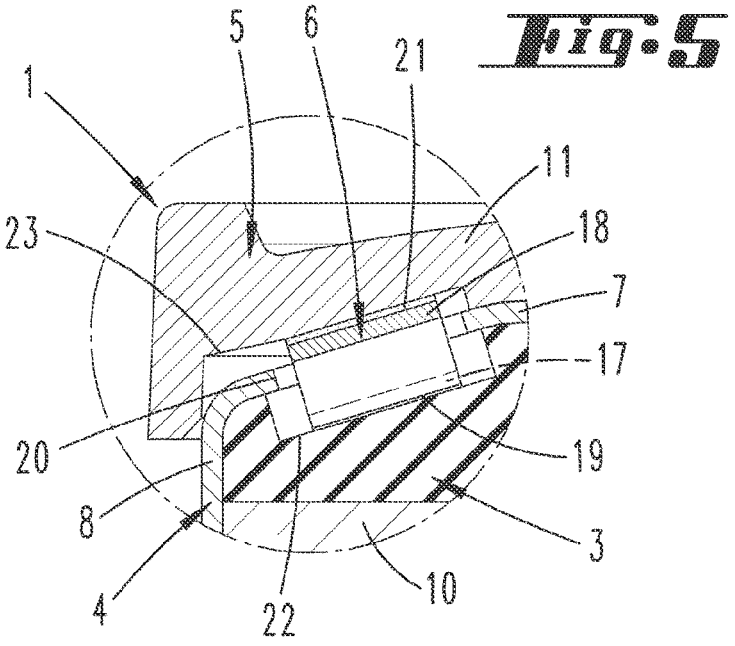
FIG. 5 the enlargement of the region V in FIG. 4.
Figure 1:
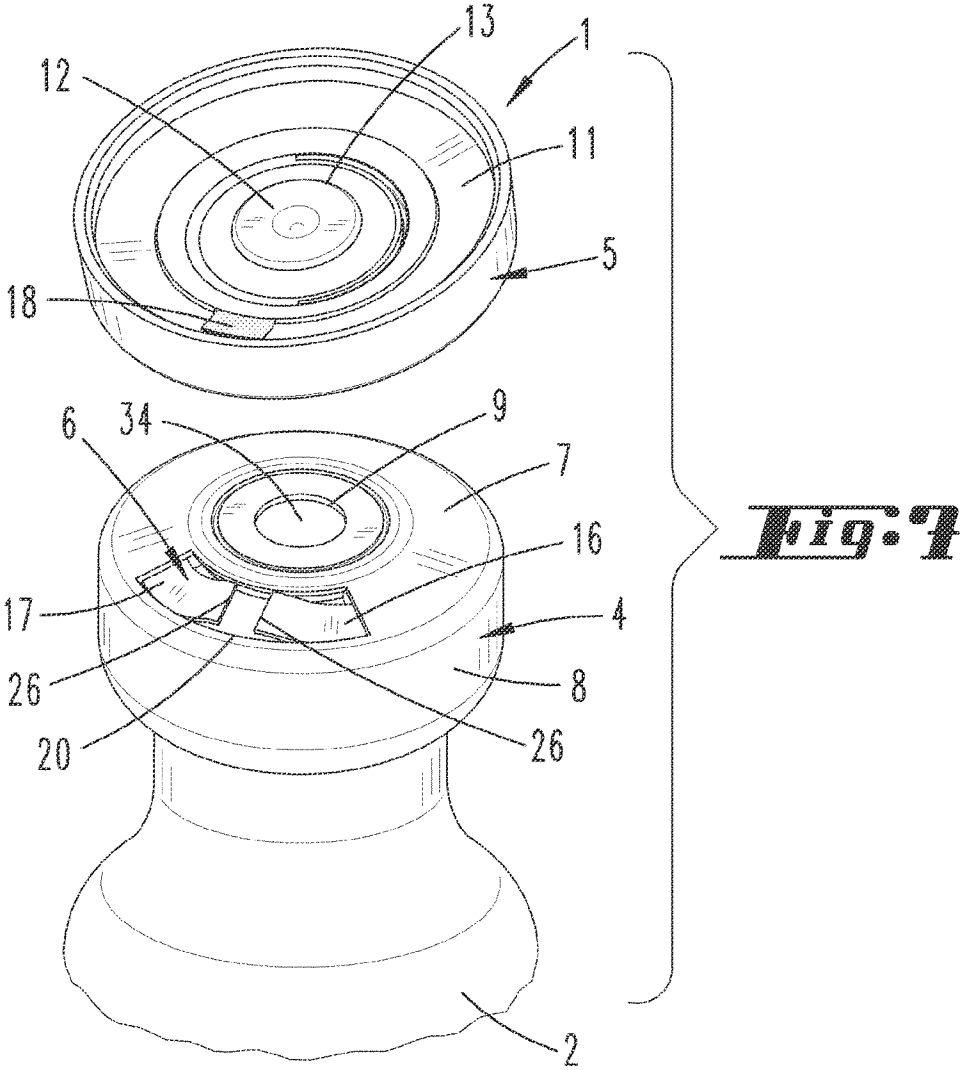

An appendage 12 can be integrally moulded to the underside of the overcap top 11, this also being preferred, and preferably has a diameter matched to the opening 9 in the metal cap 4. On the end side, the appendage 12 further has a collar-like radial extension 13, which in the covering position representing the tamper-evident closure according to FIGS. 1, 4 and 5 and also 8, 10, 12 to 14 engages beneath the edge region of the opening 9.

The plastics overcap 5 can be removed from the metal cap 4 by being torn off. The radial extension 13 elastically yields as a result of the acting tensile force, so that the position of engagement from behind is cancelled.

The metal cap 4 usually also has the aforementioned upper-side opening 9. This opening 9 is covered by the overcap 5 in accordance with the state shown for example in FIG. 4 to provide a tamper-evident closure. Once the overcap 5 has been removed, the opening 9 is released for passage by the closure stopper 3.

The memory unit 6 preferably provided in or on the closure arrangement 1 is preferably an RFID or NFC tag, correspondingly an electronic, wirelessly readable memory unit. As shown schematically for example with reference to FIGS. 6 and 9, such a memory unit 6, also referred to as a transponder, has fundamentally a memory chip 14 and an antenna 15. As also shown schematically, a plurality of antennas 15, here two antenna portions 24 and 25, can also be provided.

Figure 6:
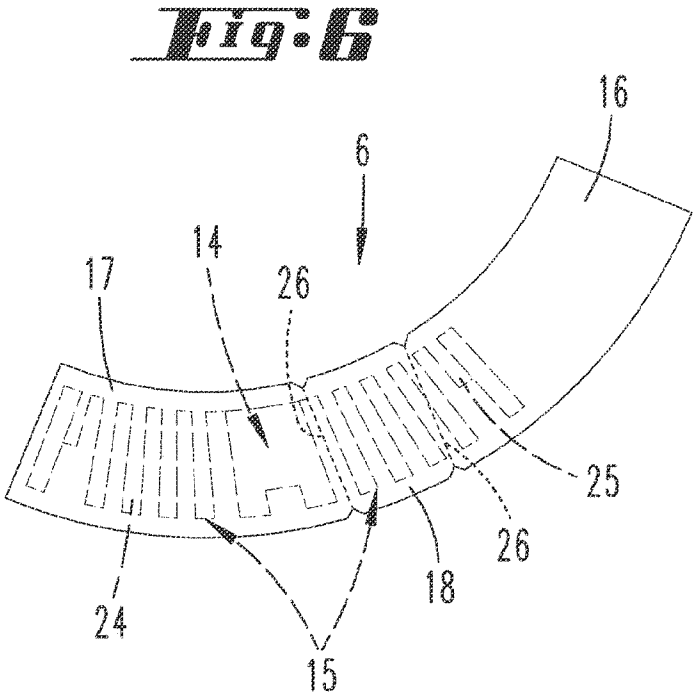
FIG. 6 an embodiment of a memory unit in plan view, relating to the intact embodiment.
Figure 9:
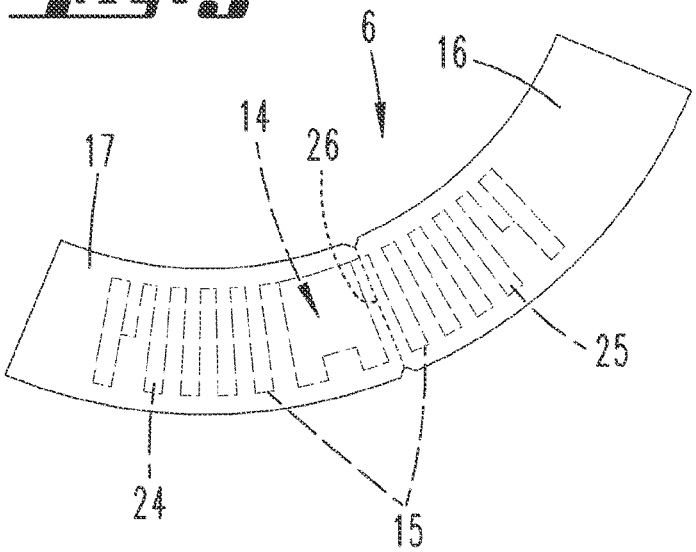
FIG. 9 an illustration corresponding to FIG. 6, but relating to a further embodiment of the memory unit.
Figure 10:
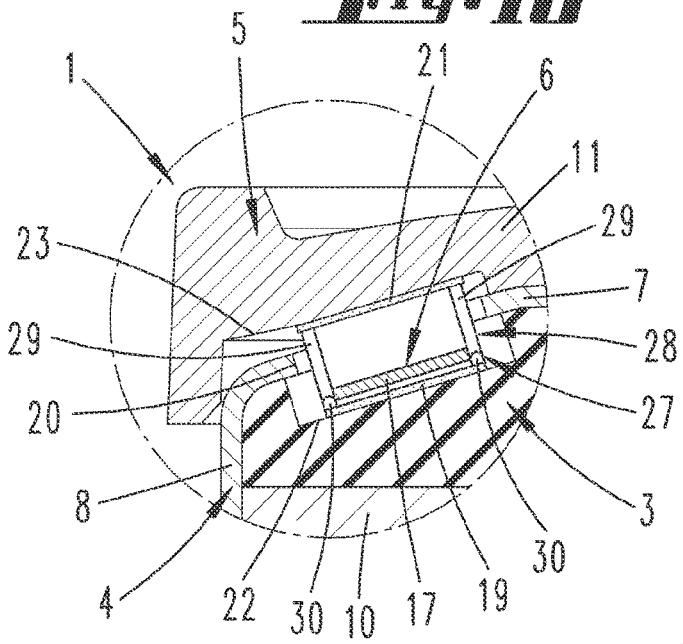
FIG. 10 a further sectional illustration corresponding to FIG. 5, relating to a further embodiment.
Figure 11:
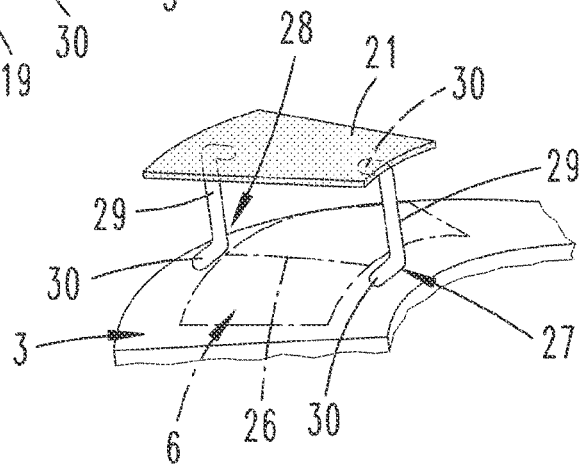
FIG. 11 a schematic perspective view of the embodiment in FIG. 10.

The memory unit 6, in accordance with the shown embodiments, can be formed in a strip-like manner, possibly running in a manner stretched lengthwise along a circular line portion in respect of a plan view according to the illustrations in FIGS. 6 and 9. However, in this regard, memory units 6 which are annular on the whole, for example, are also possible.

The memory unit 6 is arranged in such a way that, in the position covered by the overcap 5, the memory unit lies in a hidden position and, as the overcap 5 is removed, in particular torn off, experiences a lasting effect, in particular as a result of a portion of the memory unit 6 having been torn off, torn into or stretched. This lasting effect on the memory unit 6 is detectable in particular when the memory unit 6 is read via a reading unit, so that, during the course of such a reading process, it is discernible whether the overcap 5 (even if it is subsequently fitted back onto the metal cap 4) has been or is removed. In this way, the intact tamper-evident closure or cancellation of the tamper-evident closure is thus evidenced.

The lasting effect on the memory unit 6 is preferably irreversible.

FIGS. 1 to 7 show a first embodiment, in which the memory unit 6 is fastened to the closure stopper 3 on the upper side via portions 16 and 17, facing the cap top 7 of the metal cap 4. The fastening can be achieved, as is also preferred, by an adhesive layer 19. The portions 16 and 17, as is preferred, can also each be end portions of the memory unit 16. A middle portion 18, as considered in the longitudinal extension of the memory unit 6, is, by contrast, preferably not connected to the closure stopper 3, but rather to the overcap 5.

In particular in order to read the memory unit 6 arranged substantially in a position between the closure stopper 3 and the metal cap 4, a window-like aperture 20 is preferably provided in the metal cap 4. This aperture can extend fully in the width direction of the memory unit 6—in the radial direction in accordance with the usual usage position, with respect to a closure axis x, in relation to which preferably both the closure stopper 3 and also the metal cap 4 and the overcap 5 run concentrically, as does additionally preferably also the mouth edge 10. Considered in the longitudinal extension, the aperture 20 can optionally extend until over the end portions 16 and 17 of the memory unit 6. In a preferred embodiment, the resultant opening area of the aperture 20 in the surface plane of the cap top 7 is selected to be less than 40 percent up to, for example, 20 or 15 percent of the total annular metal cap surface.

The aperture 20 in this embodiment is preferably also used to guide through the middle portion 18 of the memory unit 6 and to fix the latter to the underside of the cap top 7 of the overcap 5. An adhesive layer 21 can be provided for this purpose too.

During the course of the assembly of the closure arrangement 1, this middle portion 18, once the closure stopper 3 has been fixed with use of the metal cap 4 to the opening edge 10 of the vessel 2, can protrude with its upwardly pointing adhesive layer 21 freely beyond the surface of the metal cap 4, in such a way that when the overcap 5, or the metal cap 4 possibly already connected thereto, is subsequently fitted in a latching manner, or is bent over or rather flanged, the cap top 7, in order to fix the middle portion 18, contacts this adhesive layer 21 and adheres thereto.

In order to receive the corresponding portion of the memory unit 6, indentations 22, 23 are provided both on the upper side of the closure stopper 3 and on the underside of the cap top 7. In the illustrations (for example FIG. 5), the particular depth of such an indentation 22, 23, which usually lies in the region of a few tenths of a millimetre, for example measures up to 1 mm, is shown in an exaggerated fashion.

As is also shown by way of example in FIG. 6, the memory chip 14 of the memory unit 6 is preferably provided in the region of one of the portions 16 or 17, more preferably together in the same portion 17 with an antenna portion 24. The further portion 17 comprises the second antenna portion 25, which is connected to the memory chip 14 in the portion 17 via the middle portion 18 of the memory unit 6. Here, the antenna portion 25 can further extend also over the middle portion 18. Alternatively, in the region of the middle portion 18, there is possibly just a connection line of the second antenna portion 25 to the memory chip 14.

When the overcap 5 is torn off, as is shown schematically in FIG. 7, a lasting effect is made on the memory unit 6, in such a way that, in accordance with the first exemplary embodiment, the middle portion 18 is torn off as a result of its adhesive bond to the underside of the overcap 5, and therefore the memory unit 6 is severed substantially transversely to its longitudinal extension. To this end, the memory unit 6, as also shown schematically in FIG. 6, can have designated, for example pre-embossed, predetermined tear lines 26 on both sides of the middle portion 18.

The adhesive bonding of the memory unit 6, in particular of the portions 16 and 17, to the closure stopper 3 and of the middle portion 18 to the overcap 5, at specific points or partial areas, is selected in respect of strength such that it is ensured even once the overcap 5 has been torn off. The middle portion 18 preferably remains adhered to the underside of the top of the overcap 5 after this has been torn off. The memory unit 6 is permanently severed.

The portion 17 of the memory unit 6 remaining on the closure stopper 3 preferably also comprises the memory chip 14 with the information stored therein, in particular concerning the contents of the vessel 2 and an antenna portion 24 directly associated and electrically attached.

Figure 8:
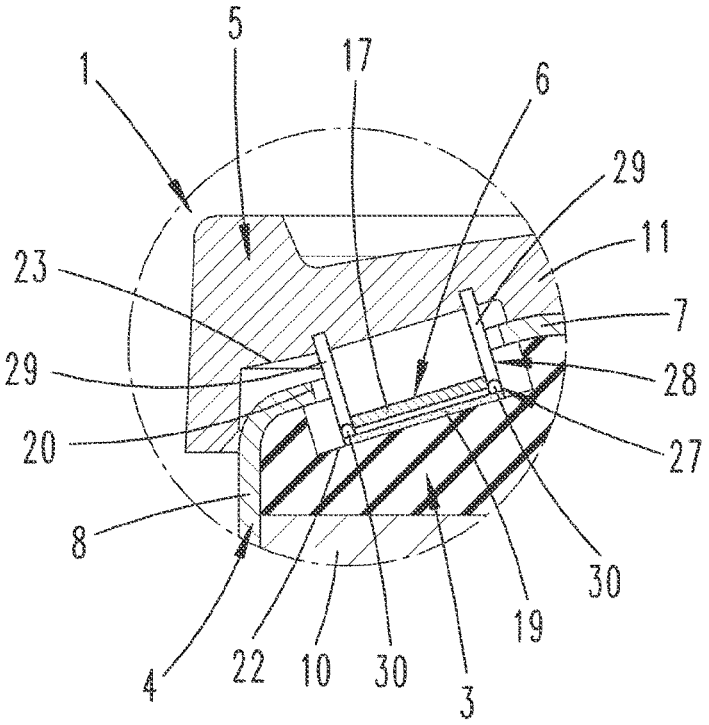
FIG. 8 a detailed view according to FIG. 5, relating to a second embodiment.

FIGS. 8 and 9 show an embodiment in which the memory unit 6 for example has only two portions 16 and 17, which are connected via just one predetermined tear line 26. Here too, the predetermined tear line 26 extends transversely over a connection region between the memory chip 14 and the second antenna portion 25.

Such a memory unit 6 can be, and preferably also is, connected, for example adhesively bonded, to the upper side of the closure stopper 3 in the end regions of each of the portions 16 and 17 pointing away from one another, whereas a middle region, also comprising the predetermined tear line 26, extends unadhered to the closure stopper 3.

This middle, preferably unadhered region of the memory unit 6 can be accompanied by a separation means 27, which is connected, preferably permanently, to the overcap 5. Such a separation means 27, as shown in the embodiments according to FIGS. 8 to 11, can be a wire 28, which in accordance with the exemplary embodiment in FIGS. 8 and 9 can be curved for example in an L shape or LL shape. First free, preferably correspondingly bent L limbs 30 of the wire 28 can be connected to the overcap 5, for example as a result of overmoulding of the free limb ends during the course of production of the overcap 5. The L web 29 connecting the L limbs 30 connects the memory unit 6, or a material region suitable for a possible effect on the memory unit 6, preferably in the region of the predetermined tear line 26, to the overcap 5. Here, the connection can be to an adhesive layer 19, which is arranged beneath the memory unit 6. The second L limb 30, however, also as a result of overmoulding or embedment, can also be incorporated in the rubber material during the course of a vulcanisation process. The second free L limb is more preferably arranged running along the memory unit 6.

When the overcap 5 is torn off, it is ensured by the wire 28, in particular L web 29 thereof, that the memory unit 6 is preferably severed along the predetermined tear line 26, so that the memory chip 24, in this embodiment too, is separated from the second antenna portion 25.

In accordance with a further embodiment, which is not shown in detail in the figures, the second and/or first L limb 30 can also span a plane, for example as the result of a zigzag course of the particular L limb 30.

Figure 12:
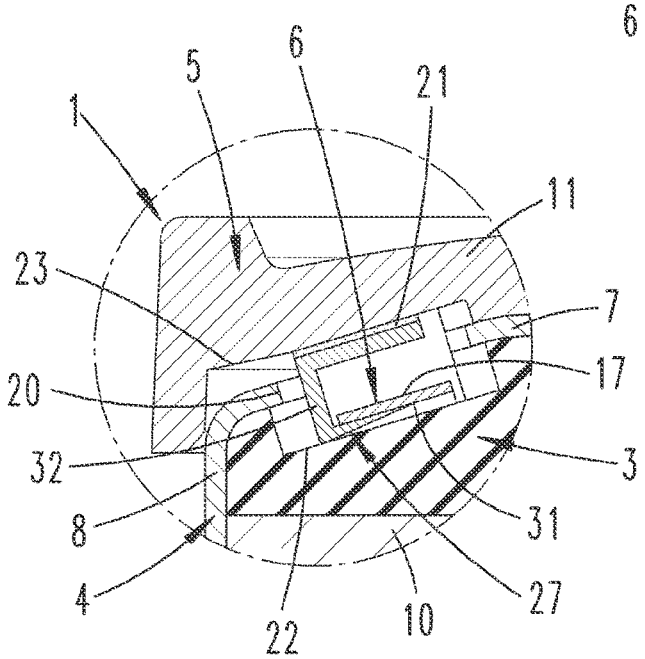
FIG. 12 a further sectional illustration corresponding to FIG. 5, relating to a further embodiment.

In addition, the separation means 27, as shown schematically in FIG. 12, can also be, for example, a cutting element 31, which can be fastened to the underside of the overcap 5 via a web 32 and an adhesive layer 21. Such a cutting element 31 can also be formed in one part with and in the same material as the overcap 5. Here, the tearing-off of the overcap 5 can lead to a (mere) tearing into the memory unit 6, possibly along a specified predetermined tear line 26. This tearing into the memory unit, however, can result for example in a separation of the memory chip 14 from the second antenna portion 25 in accordance with the previously described exemplary embodiments. In any case, a lasting effect on the memory unit 6 is hereby achievable as well.

Figure 13:
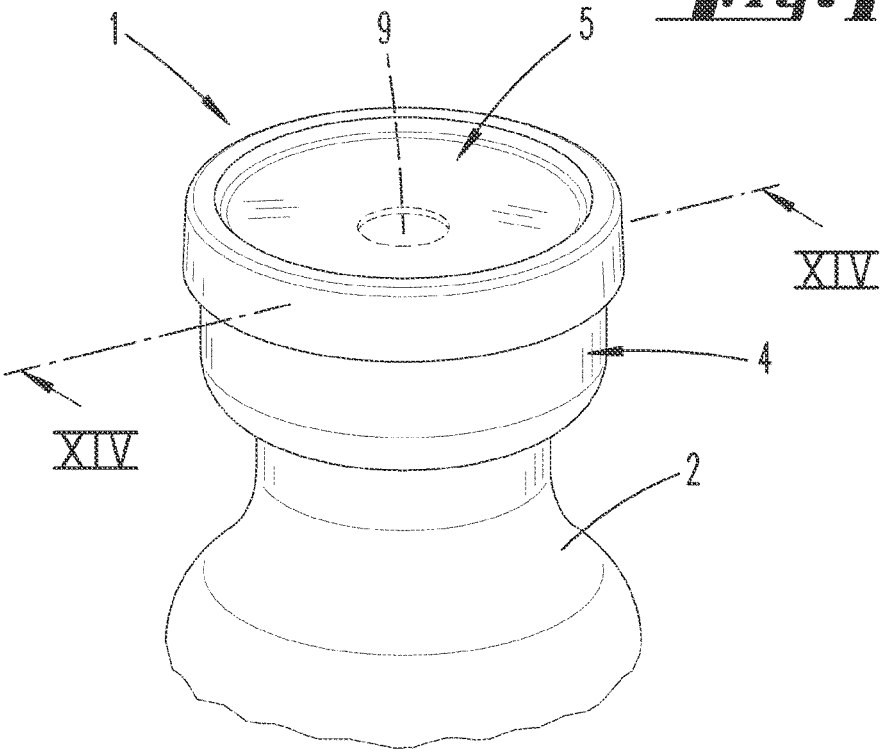
FIG. 13 an illustration corresponding to FIG. 1, relating to a further embodiment.
Figure 14:
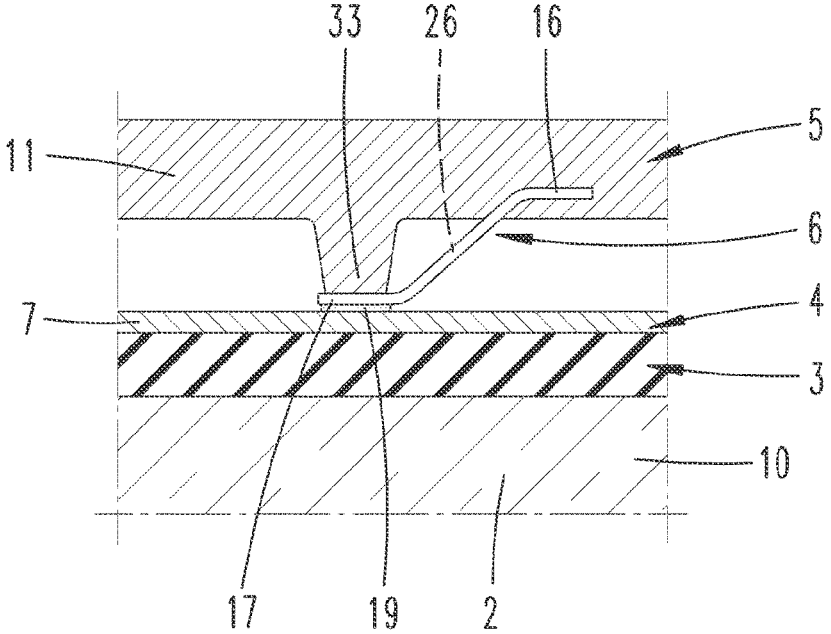
FIG. 14 a schematic sectional illustration along line XIV-XIV in FIG. 13.

FIGS. 13 and 14 show a further possible embodiment, in which the memory unit 6 is connected to the overcap 5 in the region of an end, as considered in the longitudinal extension, in particular in the region of a free end of the portion 16, as a result of overmoulding. The memory unit 6 is thus preferably permanently adhered in or to the overcap 5 at an end of the memory unit, preferably during the course of the production of the overcap 5 in a plastics injection moulding process. The further part of the memory unit 6 (in particular the portion 17 preferably connected here, too, via a predetermined tear line 26 to the portion 16 and comprising the memory chip 14 and preferably a first antenna portion 24) extends here in a flag-like manner starting from a surface of the overcap top 11 facing the surface of the metal cap 4 when arranged in position. The remote, free end of the memory unit 6 or of the further portion 17 for this purpose can be provided, as also shown, with an adhesive layer 19 facing the metal cap 4.

When the overcap 5 is fitted in place during the course of the (initial) assembly process, the portion of the memory unit 6 comprising the adhesive layer 19 on the underside can be acted on for example via a hold-down device 33 moulded integrally on the underside of the overcap 5, in such a way that a desired adhesive connection of the memory unit 6 to the surface of the metal cap 4 can be achieved.

In this embodiment too, the memory unit 6 can have a predetermined tear line 26, in particular between two portions 16 and 17, along which tear line a lasting effect can be achieved as a result of a severing of the memory unit 6 when the overcap 5 is torn off.

A further possible embodiment is shown in FIGS. 15 to 20. As can be seen, the top of the closure stopper 3 in this design does not extend, as in the previously described embodiments, in a dome-like manner, but rather in a manner oriented substantially along a plane running transversely to the closure axis x. Similarly to the previously described exemplary embodiments, a bead-like depression 34 can be, and preferably also is, provided such that the closure axis x runs through it centrally, and into which, also in the embodiment according to FIGS. 15 to 20, the radial extension 13 of the overcap 5 can protrude.

The memory unit 6, as shown, can be formed on the whole in a planar or disc-like manner, with a diameter which can correspond substantially to the outer diameter of the closure stopper 3.

Figure 15:
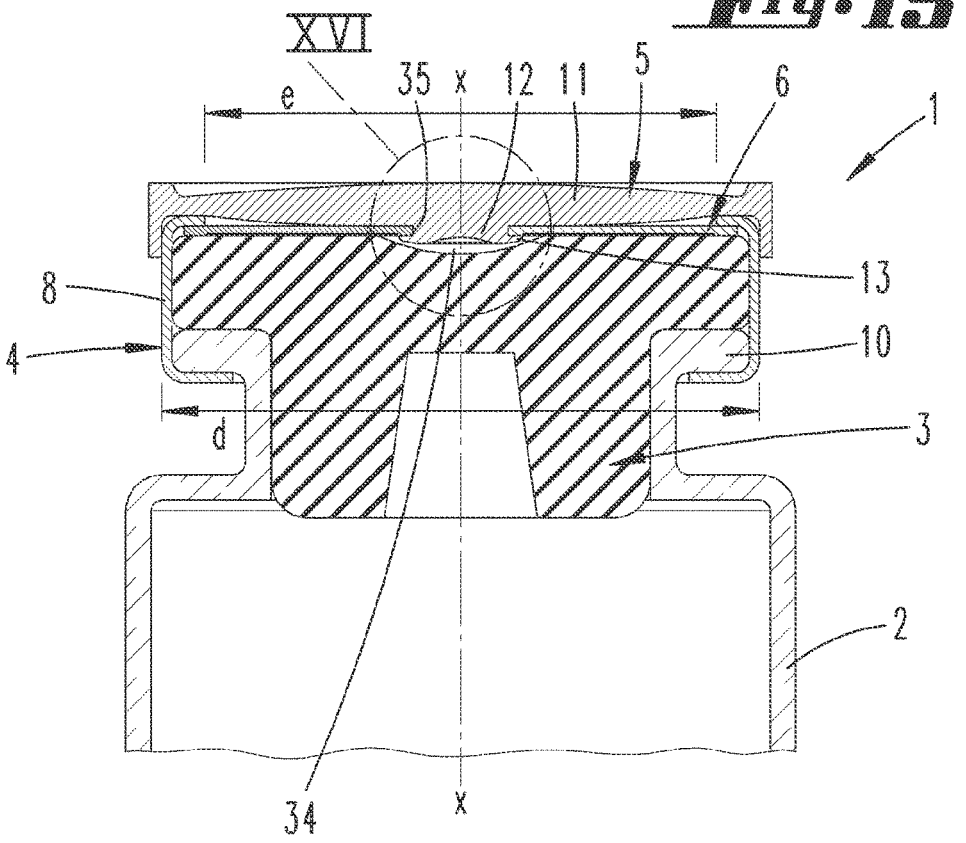
FIG. 15 a further embodiment in a sectional view according to FIG. 4.
Figure 16:
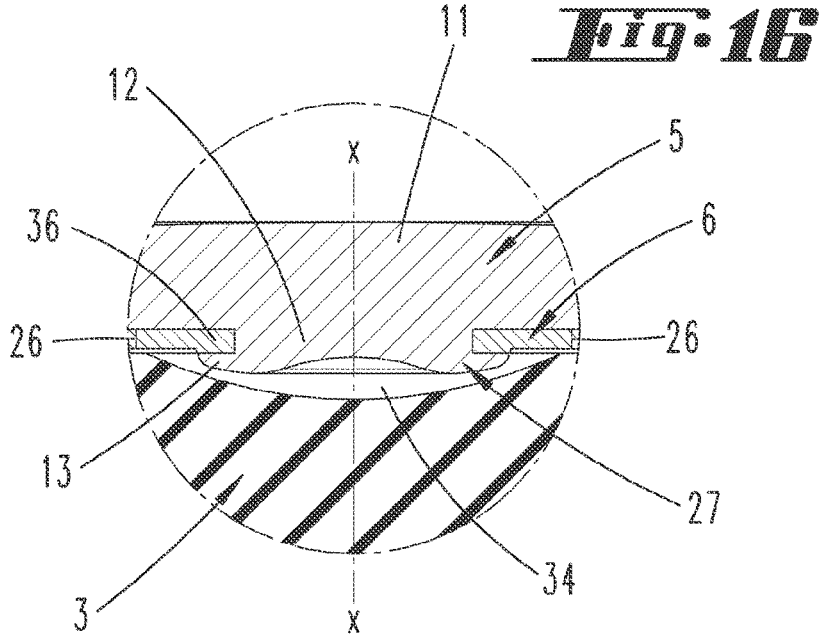
FIG. 16 an enlargement of the region XVI in FIG. 15.

A bore-like opening 35 is provided in the middle in the memory unit 6, passed through centrally by the geometric closure axis x, and in the correct closure state of the closure arrangement 1 according to FIG. 15 is passed through by the appendage 12 of the overcap 5. The radial extension 13 adjoining the appendage 12 engages here beneath the edge portion 36 of the memory unit 6 surrounding the opening 35 (see also FIG. 16).

A predetermined tear line 26, formed for example by perforation, runs in the carrier material of the memory unit 6, preferably consisting of a plastics material, concentrically to the geometric centre axis of the opening 35 and at a radial distance from the edge of the opening. A circular ring-like edge portion 36 is produced between this predetermined tear line 26 and the opening 35.

The radial extension 13 of the overcap 5 engages beneath the region of the edge portion 36 and ends accordingly in the radial direction preferably at a radial distance from the predetermined tear line 26.

A memory chip 14 is held in the carrier material of the memory unit 6, for example by partial or full overmoulding with plastics material. An antenna 15 is electrically connected to the memory chip 14 and can extend in a spiral shape in approximately concentric circles to the closure axis x (see FIG. 17).

Figure 17:
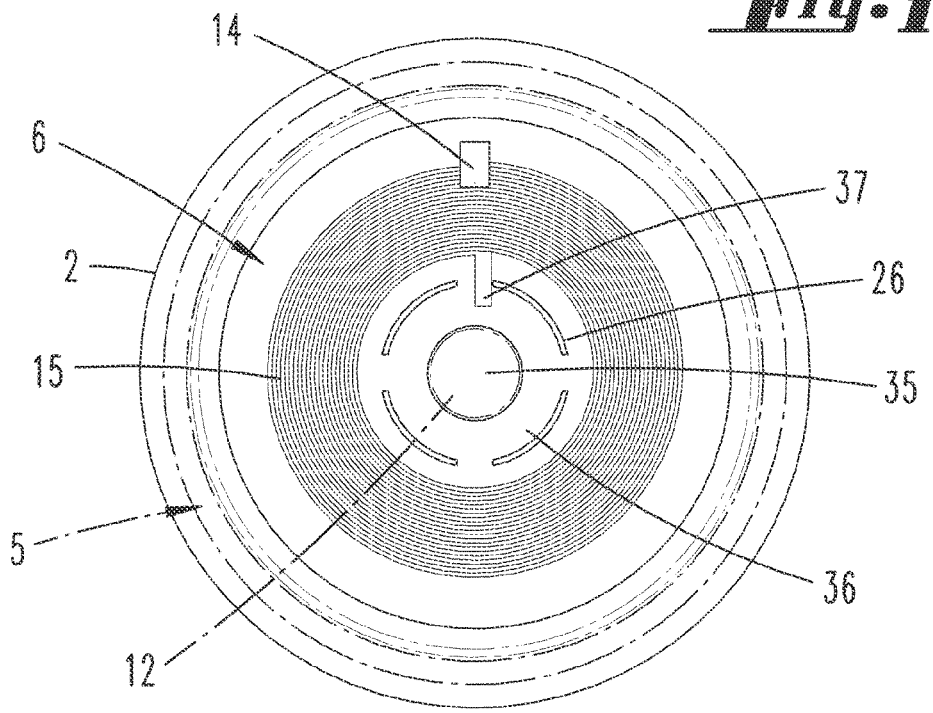
FIG. 17 the memory unit of the region XVI in FIG. 15.
Figure 18:
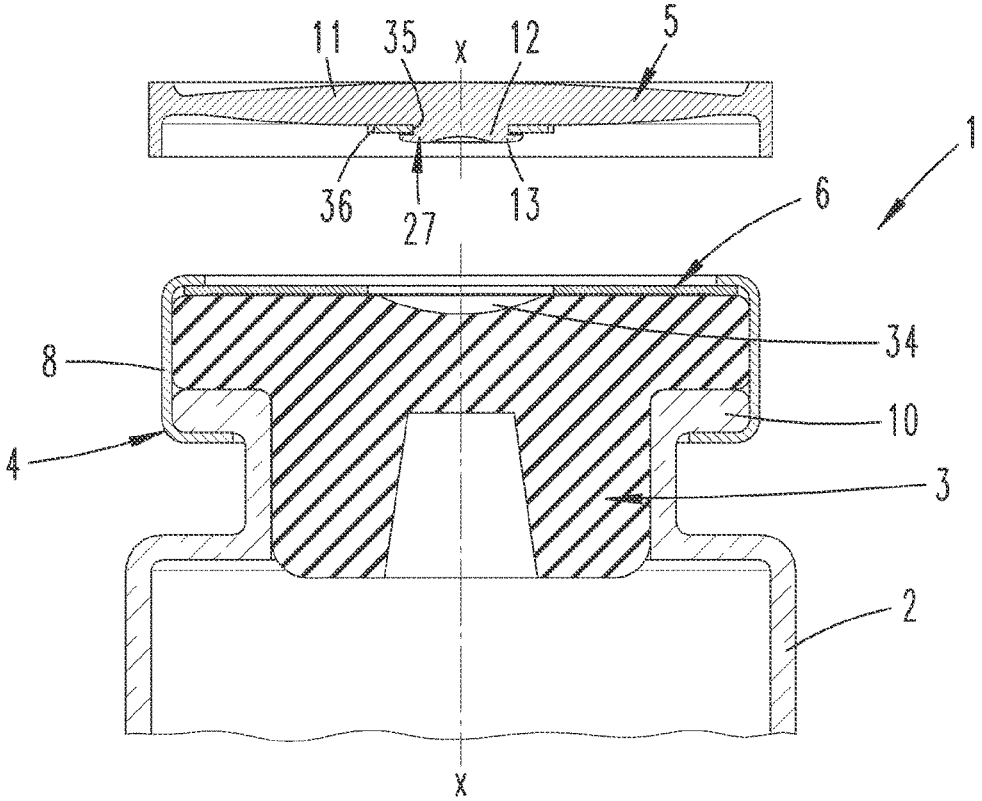
FIG. 18 an illustration corresponding substantially to FIG. 15, but following removal of the overcap.
Figure 19:
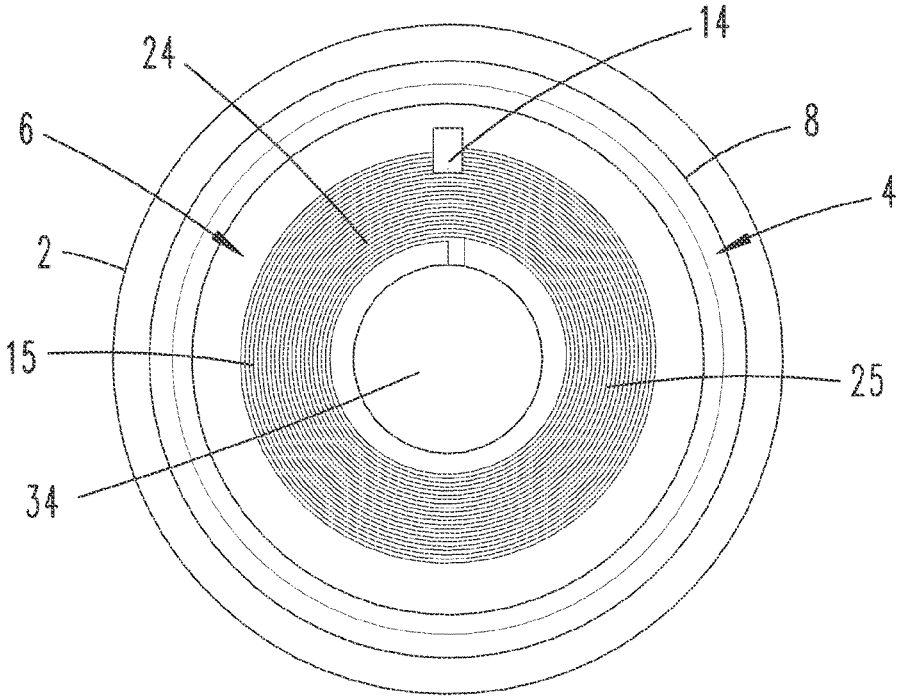
FIG. 19 the memory unit in a plan view according to FIG. 17, but following destruction by removal of the overcap.
Figure 20:
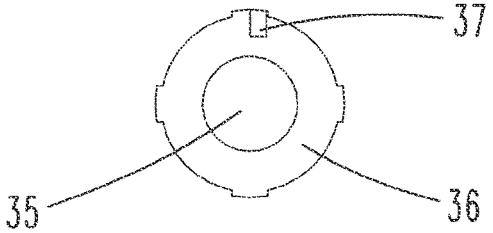
FIG. 20 a schematic illustration of the portion separated from the memory unit by removal of the overcap.

A substantially radially running antenna arm 37 extends out from the spiral circles of the antenna 15, crossing the predetermined tear line 26 inwardly into the region of the radial portion 36 (see FIG. 17).

The memory unit 6 is held in this embodiment by being overlapped by the metal cap 4 lying on the closure stopper 3. The memory unit 6 can accordingly lie substantially unsecured between the metal cap 4 and the closure stopper 3.

The opening 9 of the metal cap 4 in this case has a diameter e which can correspond approximately to 0.8 to 0.95 times the outer diameter d of the metal cap 4. A cap top 7 overlying the memory unit 6 in a collar-like manner can thus be provided circumferentially at the edge. The outer diameter of the antenna 15 formed in a spiral shape can be selected here, as is preferred, to be smaller than the diameter e of the opening 9 in the metal cap 4.

The overcap 5 can lie substantially flat on the collar-like edge of the cap top 7.

When the overcap 5 is torn off, the radial extension 13 acts as a separation means 27. The edge portion 36 arranged beneath the separation means 27 tears off this edge portion 36 in a circular ring-line manner along the predetermined tear line 26, thus severing the antenna arm 37 protruding radially inwardly into the edge portion 36. The antenna 15 is thus divided into two electrically separate antenna portions 24 and 25, of which at most an antenna portion may still be electrically connected hereafter to the memory chip 14.

The torn-off edge portion 36 preferably remains with the separated antenna arm 37 on the continuation 12 of the overcap 5.

Due to the separated antenna arm 37 and the associated cancellation of the functionality of the antenna 15, a lasting effect on the memory unit 6 is achieved as a whole.

The above embodiments serve to explain the inventions encompassed as a whole by the application, which further develop the prior art at least by the following combinations of features, also independently in each case, wherein two, more or all of these combinations of features can also be combined, as follows:

A closure arrangement which is characterised in that an operative connection of the memory unit 6 both to the overcap 5 and to the closure stopper 3 is provided and causes a lasting effect on the memory unit 6 when the overcap 5 is torn off.

A closure arrangement which is characterised in that the memory unit 6, which has experienced an effect as a result of the overcap 5 having been torn off, when read transmits information resulting from the overcap having been torn off.

A closure arrangement which is characterised in that the memory unit 6 comprises an RFID or NFC tag.

A closure arrangement which is characterised in that the memory unit 6 is adhesively connected to the overcap 5 and/or the closure stopper 3.

A closure arrangement which is characterised in that the memory unit 6, in its region associated with the overcap 5, is overmoulded partially or fully with plastics material.

A closure arrangement which is characterised in that the memory unit 6, in its region associated with the closure stopper 3, is embedded partially or fully in the material of the closure stopper 3.

A closure arrangement which is characterised in that the memory unit 6 can be acted on destructively when the overcap 5 is removed.

A closure arrangement which is characterised in that the metal cap 4 has an opening 9 which is greater than half to eight tenths or nine tenths or more of the outer diameter d of the metal cap 4.

A closure arrangement which is characterised in that the overmoulded memory unit 6 is accommodated lying loosely between the metal cap 4 and the closure stopper 3.

A closure arrangement which is characterised in that the memory 6 overmoulded with plastics material has a predetermined tear line 26 for separating part of the memory unit 6.

A closure arrangement which is characterised in that the memory unit 6, in the region separated by the predetermined tear line 26, is acted on from beneath by a separation means 27 of the overcap 5.

A closure arrangement which is characterised in that the predetermined tear line 26 runs through a portion 24, 25 of an antenna 15 of the memory unit 6.

A closure arrangement which is characterised in that a wire 28 is provided as separation means 27 in order to separate the memory unit 6.

A closure arrangement which is characterised in that the wire 28 is fixedly connected to the overcap 5.

All disclosed features are (within themselves, but also in combination with one another) essential to the invention. The disclosure content of the associated/appended priority documents (copy of the pre-application) is hereby also incorporated fully into the disclosure of the application, also for the purpose of including features from these documents in claims of the present application. The dependent claims characterise with their features, also without the features of a referenced claim, independent inventive further developments of the prior art, in particular in order to make divisional applications on the basis of these claims. The invention described in each claim can additionally have one or more of the features specified in the above description, in particular provided with reference numerals and/or stated in the list of reference numerals. The invention also relates to embodiments in which individual features stated in the above description are not implemented, in particular insofar as they are clearly unnecessary for the particular purpose or can be replaced by other technically equivalent means.

LIST OF REFERENCE SIGNS

1 closure arrangement
2 vessel
3 closure stopper
4 metal cap
5 overcap
6 memory unit
7 cap top
8 cap wall
9 opening
10 vessel mouth edge
11 overcap top
12 appendage
13 radial extension
14 memory chip
15 antenna
16 portion
17 portion
18 centre portion
19 adhesive layer
20 aperture
21 adhesive layer
22 indentation
23 indentation
24 antenna portion
25 antenna portion
26 predetermined tear line
27 separation means
28 wire
29 L web

30 L limb
31 cutting element
32 web
33 hold-down device
34 depression
35 opening
36 edge portion
37 antenna arm
d outer diameter
e diameter
x closure axis

The invention claimed is:

1. A closure arrangement (1) for a vessel (2) containing a pharmaceutical substance, comprising: a closure stopper (3), a metal cap (4) configured for securing the closure stopper (3) on the vessel (2), and an overcap (5) made of plastic, the metal cap (4) being disposed between the closure stopper (3) and the overcap (5), wherein, for the purpose of identifying contents of the vessel (2), a wirelessly readable, electrical memory unit (6) is connected to the closure arrangement (1), wherein an operative connection of the memory unit (6) both to the overcap (5) and to the closure stopper (3) is provided and has a lasting effect on the memory unit (6) when the overcap (5) is torn off, wherein the metal cap has a first opening (9) and a second opening (20), and wherein the operative connection occurs through the second opening (20).

2. The closure arrangement according to claim 1, wherein the memory unit (6), which has experienced an effect as a result of the overcap (5) having been torn off, is configured to when read transmit information resulting from the overcap having been torn off.

3. The closure arrangement according to claim 1, wherein the memory unit (6) is an RFID or NFC tag.

4. The closure arrangement according to claim 1, wherein the memory unit (6) is adhesively connected to the overcap (5) and/or the closure stopper (3).

5. The closure arrangement according to claim 1, wherein the memory unit (6), in a region associated with the overcap (5), is partially or fully overmolded with plastic.

6. The closure arrangement according to claim 5, wherein the memory unit (6) has a predetermined tear line (26) for separating part of the memory unit (6).

7. The closure arrangement according claim 6, wherein the predetermined tear line (26) runs through a portion (24, 25) of an antenna (15) of the memory unit (6).

8. The closure arrangement according to claim 6, wherein a wire (28) is provided as a separation means (27) to separate the memory unit (6).

9. The closure arrangement according to claim 8, wherein the wire (28) is fixedly connected to the overcap (5).

10. The closure arrangement according to claim 1, wherein the memory unit (6), in a region associated with the closure stopper (3), is partially or fully embedded in the material of the closure stopper (3).

11. The closure arrangement according to claim 1, wherein the memory unit (6) is destructible as a result of removal of the overcap (5).

12. The closure arrangement according to claim 1, wherein the metal cap (4) has an opening (9) which is larger than half of an outer diameter (d) of the metal cap (4).

13. The closure arrangement according to claim 1, wherein the memory unit (6) is accommodated between the metal cap (4) and the closure stopper (3).

14. The closure arrangement (1) according to claim 1, wherein the memory unit (6) has an antenna and a memory chip (14), wherein the memory unit (6) is destroyed when the overcap is torn off, and wherein the memory unit (6) has two portions connected via a predetermined tear line, the tear line extending transversely over a connection region between the memory chip and the antenna.

15. A closure arrangement (1) for a vessel (2) containing a pharmaceutical substance, comprising: a closure stopper (3), a metal cap (4) configured for securing the closure stopper (3) on the vessel (2), and an overcap (5) made of plastic, wherein, for the purpose of identifying contents of the vessel (2), a wirelessly readable, electrical memory unit (6) is connected to the closure arrangement (1), wherein an operative connection of the memory unit (6) both to the overcap (5) and to the closure stopper (3) is provided and has a lasting effect on the memory unit (6) when the overcap (5) is torn off, wherein the memory unit has a predetermined tear line for separating part of the memory unit (6), and wherein the memory unit (6), in a region separated by the predetermined tear line (26), is acted on from beneath by a separation means (27) of the overcap (5).

* * * * *